US006138279A

United States Patent [19]

Gore

[11] Patent Number: 6,138,279

[45] Date of Patent: Oct. 31, 2000

[54] VISOR CAP, THE VISOR INSERT THEREFORE AND THE METHODS OF MANUFACTURING

[75] Inventor: Allan E. Gore, Lancaster, Pa.

[73] Assignee: Bollman Hat Company, Adamstown, Pa.

[21] Appl. No.: 09/386,277

[22] Filed: Aug. 31, 1999

[51] Int. Cl.[7] ..... A42B 1/00

[52] U.S. Cl. ..... 2/175.5; 2/175.4; 2/175.1; 2/195.1; 2/195.5; 2/195.6

[58] Field of Search ..... 2/2.15, 175.1, 2/175.5, 175.3, 175.4, 195.1, 195.5, 209.12

[56] References Cited

U.S. PATENT DOCUMENTS

D. 285,981 10/1986 Ekins .
D. 302,608 8/1989 LaPierre .
D. 303,852 10/1989 Lee .
D. 306,222 2/1990 Lee .
D. 349,389 8/1994 Phillips .
D. 351,273 10/1994 McKinley .
D. 358,006 5/1995 Chisolm et al. .
D. 360,289 7/1995 McKinley .
D. 360,290 7/1995 McKinley .
D. 360,291 7/1995 McKinley .
D. 377,108 1/1997 Schulz .
D. 377,708 2/1997 Bay, Jr. .
D. 396,945 8/1998 Glass .
2,556,016 6/1951 Turshin .
2,718,010 9/1955 Graham .
3,072,915 1/1963 Henschel .
3,344,437 10/1967 Greene .
3,402,865 9/1968 Moreau .
4,333,180 6/1982 Bay .
5,253,369 10/1993 Patterson, Jr. .
5,533,652 7/1996 Levin .

*Primary Examiner*—John J. Calvert
*Assistant Examiner*—Robert H. Muromoto, Jr.
*Attorney, Agent, or Firm*—Shlesinger, Arkwright & Garvey LLP

[57] ABSTRACT

This invention relates to hats and especially caps which have a visor such as a brim or bill and more particularly to the visor insert for maintaining a lasting shape to the visor once the insert has been positioned in the visor portion of the hat and the method of manufacturing the visor insert and the cap associated therewith whereby the visor insert will maintain a long lasting memory even under high heat moisture and stress distortion.

23 Claims, 1 Drawing Sheet

VISOR CAP, THE VISOR INSERT THEREFORE AND THE METHODS OF MANUFACTURING

FIELD OF THE INVENTION

This invention pertains to hats with visors such as bills or brims and especially caps and particularly to means for maintaining the shape of the visor even when under great distortion, pressure, moisture and high temperatures for a long period of time.

HISTORY AND BACKGROUND OF THE INVENTION

Caps with visors have been available to the public in general for a great many years. Caps with visors are worn in many sporting activities as well as for outdoor activities such as picnics, beach vacations, hunting and fishing and the like. For years, the visor have been stiffened by cardboard, plastic or metal material either inserted into a pocket in the cloth configuration of a visor or as the visor portion itself. Visors typically consist of three(3) plies or layers of material. The top and bottom ply is usually a woven cloth material, oftentimes a cotton, poly/cotton, or another blend of natural and man-made fibers. The top and bottom plies are visible to the naked eye. The middle ply (visor insert) is usually made of cardboard, latex impregnated paperboard or foam plastic-type materials. The three plies are pre-cut to the desired visor shape and then sewn together using a sewing machine which will sew from 2 to 8 rows of stitches. These rows of stitches permanently hold together 3 plies. The visor is then sewn to the crown of the cap. All types of materials have been used, but all show undesirable qualities, such as metal being too rigid and inflexible, and cardboard, latex impregnated paperboard and foam plastic showing the tendency to warp and change configuration from the original set configuration. People fold up their caps and stick them in their pocket or pack for subsequent use or by accident sit on them. In so doing, they become creased, crinkled and deformed failing to regain their original or intended shape. Further, where plastic such as foam plastic for the visor has been used, the plastic tends to deform and distort under great pressures and high temperatures, failing to return to the original set shape. It is well known that the temperature of an automobile left in the sun for several hours may reach 180° F. or more. Caps with cardboard or latex impregnated paperboard bills or visors deform easily when exposed to rain or are accidentally dropped in water. If a cap fails to return to normal set, it is usually so damaged that it must be discarded.

OBJECT AND SUMMARY OF THE INVENTION

It is an object of this invention to provide a visor insert for a hat which will maintain the initial shape set in the visor, brim or bill at the time of manufacture and continue to maintain the initial shape even under adverse conditions.

Another object of this invention is to provide a visor hat or cap which may be folded, packed and/or stored without permanently changing the initial set of the visor.

Yet another object of this invention is to provide a visor insert which is readily and inexpensively manufactured.

Still a further object of this invention is to provide a visor insert which will take extreme changes in temperature and pressure without losing its original set memory.

It is still a further object of this invention to provide a method of manufacturing a visor insert for a hat in which the steps of manufacturing are readily implemented and controlled.

It is also an object of this invention to provide a visor insert which can be readily manufactured without elaborate cooling apparatus.

Yet another object of this invention is to provide a visor inset which will permit the visor insert to be formed into a wide range of configurations both angular and curvilinear.

In summary, this invention relates to a hat, the visor insert therefore and the method of manufacturing which will provide a durable, lightweight, easily handable, distorable visor hat which can sustain severe distortion, pressure, moisture, and high temperature for extended periods of time without losing the original shape.

These and other objects will be apparent from the following descriptions and the drawings which are described as follows:

BRIEF DESCRIPTIONS OF THE DRAWINGS

DETAILED DESCRIPTION OF THE INVENTION

Figure 1:
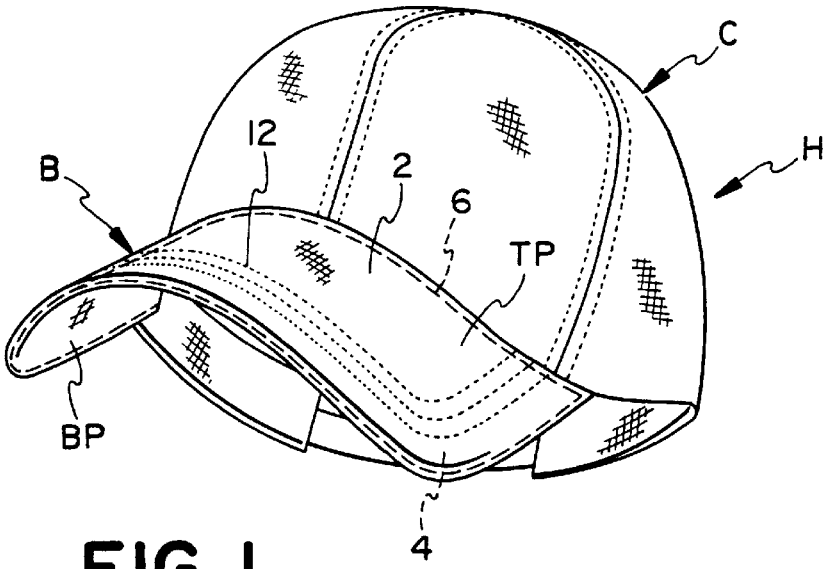
FIG. 1, is a perspective view of a cap. The visor with the visor insert shown in phantom lines.
Figure 2:
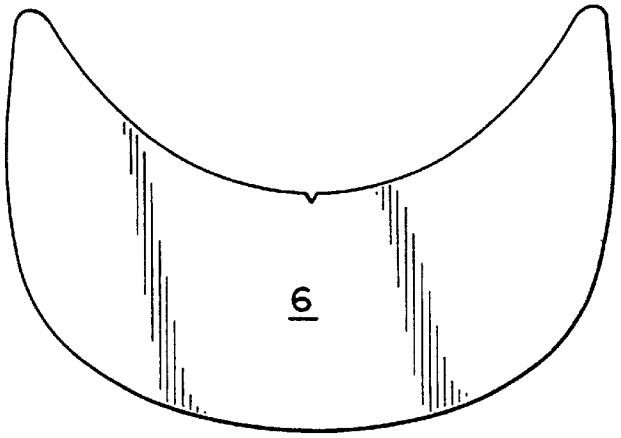
FIG. 2, shows the visor insert in top plan view.

FIG. 1, shows a typical hat or cap H. The cap H is provided with a visor such as brim or bill B which is stitched and otherwise secured to the crown C. The visor or bill B comprises an outer covering 2 of visor or bill-shaped configuration which comprises two plies; a top ply TP and a bottom ply BP which form a pocket or laminate 4. A visor insert 6 is positioned in the pocket 4 or inserted between the top and bottom plies TP and BP. FIG. 2, illustrates the configuration of the visor insert 6. The visor insert 6 may take various configurations including the arc form 8 of FIG. 3 and the inverted V-form 10 of FIG. 4.

There has always been a demand for visors of hats including caps which will maintain a particular set or shape and not loose the set or shape once put on the head. Repeated taking off and putting on resulted in the visor losing its original shape particularly if sat upon, packed or bunched up or left in a vehicle in the summertime when temperatures in the vehicle might exceed a 180° F. and oftentimes even higher temperatures near 200° F. In order to achieve a set or shape for the visor B, it was necessary to find a visor including a brim or bill insert 6 which would withstand severe abuse even under the high temperature of summer in an automobile and not lose its memory and become distorted and unsuitable for use by the wearer because of the distorted appearance.

By much testing and experimentation, this invention provides a visor insert 6 which will have a fixed or set configuration which will have a lasting memory and not distort under severe temperatures and deformation conditions. Insert 6 is also of a material which can be stitched through and secured to the top and bottom plies, TP and BP of the cap visor covering 2 usually consisting of cloth and/or other suitable materials such as leather, or lightweight plastic or the like.

In order to provide a visor insert of flexible long lasting memory, a thermoplastic resin material must be used having a tensil strength of between about 2750 psi to about 5000 psi with a flexural strength of between 1680 psi and about 8500 psi with a flexural modulus of elasticity of between about 45,000 psi to about 280,000 psi, and which has a melt temperature of about 470° F. to about 510° F. The thickness of the sheet material from which the visor insert 6 is stamped must be from about 0.045" to about 0.075" with optimum thickness of 0.055" to 0.065". The preferred tensil strength of the material should be about 3000 psi to about 3400 psi. The optimum flexural strength should be about 3500 psi 5500 psi and the preferred flexural modulus of elasticity should be about 90,000 psi to about 160,000 psi.

It has been found that the most desirable thickness should be about 0.06".

Figure 3:
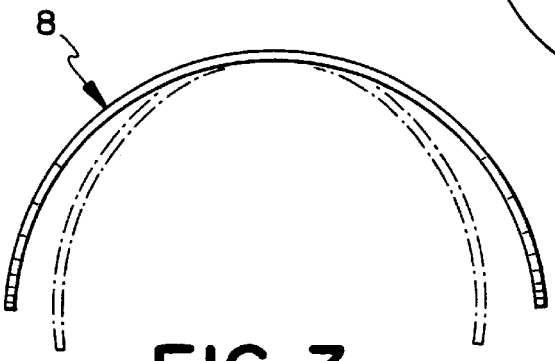
FIG. 3, shows the visor insert in perspective and set in an arc configuration showing flex in phantom lines.
Figure 4:
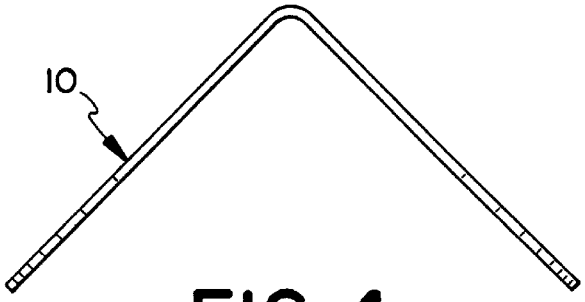
FIG. 4, shows the visor insert after being formed in an inverted V configuration.

In manufacturing the bill insert 6 to provide the desired shape such as arc form 8 and inverted V-form 10, the visor insert 6 is flexed to the desired shape and placed in a jig set to that desired shape to be held in that position during the transformation of the initial memory to the desired shape memory. Once the visor insert 6 is positioned in the jig which has been set to the desired shape, the visor insert 6 will be heated in the jig to a temperature of between about 320°0 F. and about 375° F. It will then be maintained at the aforementioned temperature and more particularly at a temperature of about 350° F. for at least about a minimum of 15 minutes and preferably about 20 minutes which will be sufficient to reset the crystal structure of the thermoplastic resin as well as resetting the long lasting memory into the new configuration such as illustrated in FIGS. 3 and 4. Alternatively, the visor insert 6 may be heated to the temperature of between about 320° F. and about 375° F., and placed in a mold and molded and/or shaped and subsequently heated for at least 15 minutes and preferably about 20 minutes in the mold or jig.

It has been found that rapid cooling of the visor insert after the heating period has expired, tends to weaken the memory considerably so as to make the visor insert subject to deformation and distortion with loss of memory. In order to overcome and maintain the crystalline structure which has been set by the temperature and time factors referred to above, a gradual cooling is carried out to a temperature of less than about a 150° F. over a period of about 40 minutes to about 60 minutes. This gradual cooling over this period of time to the temperature of less than about 150° F., avoids degradation and loss of the reset of the long lasting memory. Further it has been found that the visor insert 6 in the new configuration can withstand temperatures in the range of 180° F. to about 200° F. for at least five hours without loss of the reset long lasting memory.

Once the temperature of about 150° F. has been reached, after the cooling period of about 40 to about 60 minutes, the visor insert 6 can be removed from the jig or mold and inserted into the pocket 4 of the hat H or positioned between the top ply TP and bottom ply BP and sewn together to form the complete visor or bill B of cap H. Stitching 12 can be applied to sew the visor insert 6 to form the bill B and permanently positioned it so that it will not slide around or move in the pocket 4 or between plies TP and BP.

A number of different types of thermoplastic resins are available on the marketplace having the desired characteristics mentioned above including the polyester thermoplastic resin sheet material obtained from Penn Fibre, Inc. and entitled VANDAR.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. The method of manufacturing a visor insert for a hat comprising the steps of:

a) providing a visor insert of flexible, long lasting memory thermoplastic resin material having a thickness from about 0.045" to about 0.075", a tensil strength of between about 2750 psi to about 5000 psi, a flexural strength of between about 1680 psi and about 8500 psi, a flexural modulus elasticity of between about 45,000 psi to about 280,000 psi, and a melt temperature of about 470° F. to about 510° F.;

b) flexing said visor insert to a desired shape;

c) placing said flexed visor insert in a jig set to said desired shape;

d) heating said visor insert in said jig to a temperature of about 350° F. and about 375° F. and maintaining said temperature for at least about 15 minutes minimum to reset the crystalline structure and long lasting memory of said thermoplastic resin material of said visor insert to the desired shape;

e) gradually cooling said visor insert in said jig to a temperature of less than about 150° F. over a period of about 40 minutes to about 60 minutes after said at least 15 minutes heating to avoid degradation and loss of said reset long lasting memory and removing from said jig; and f) whereby said visor insert upon removal from said jig will retain the desired shape even under distortion of said visor insert and under temperatures of about 180° F. to about 200° F. for a period of at least 5 hours without loss of said reset long lasting memory.

2. The method of claim 1, including the steps of:

a) providing a hat having a visor with pocket for receiving a visor insert; and b) inserting said cooled reset visor insert into said pocket.

3. The method of claim 2 and including the step of:

a) closing the pocket subsequent to receiving the visor insert.

4. The method of claim 1 and wherein:

a) the thickness is in the range of 0.055" to 0.065";

b) said tensil strength is about 3000 psi to about 3400 psi;

c) said flexural strength is about 3500 psi to about 5500 psi;

d) said flexural modulus elasticity is about 90,000 psi to about 160,000 psi;

e) said heating temperature is about 350° F.; and f) said maintaining of said heating temperature is about 20 minutes.

5. The method of claim 4 including the steps of:

a) providing a hat having a visor with pocket for receiving a visor insert; and b) inserting said cooled reset visor insert into said pocket.

6. The method of claim 5 including the steps of:

a) closing the pocket subsequent to receiving the visor insert.

7. The method of claim 1 and including:

a) providing a sheet of visor insert flexible long lasting memory thermoplastic resin material; and b) blanking out from said sheet said visor insert prior to flexing said visor insert to said desired shape.

8. The method of claim 7 including the steps of:

a) providing a hat having a visor with pocket for receiving said cooled reset visor insert; and b) inserting said cooled reset visor insert into said pocket.

9. The method of claim 8 and including the step of:

a) closing the pocket subsequent to receiving the cooled reset visor insert.

10. A visor insert made by the method of claim 1 and wherein:

a) said desired shape is a crescent.

11. A visor made by the method of claim 4 and wherein:

a) said desired shape is a crescent.

12. The method of claim 6 and including the steps of:

a) stitching said cooled insert to said pocket to lock said cooled reset visor insert in said pocket to prevent slip of said cooled reset visor insert in said pocket.

13. The method of manufacturing a visor insert for a hat comprising the steps of:

a) providing a visor insert of flexible, long lasting memory thermoplastic resin material having a thickness from about 0.045" to about 0.075", a tensil strength of between about 2750 psi to about 5000 psi, a flexural strength of between about 1680 psi and about 8500 psi, a flexural modulus elasticity of between about 45,000 psi to about 280,000 psi, and a melt temperature of about 470° F. to about 510° F.;

b) heating said visor insert to a temperature of about 350° F. and about 375° F.;

c) placing said heated visor insert in a mold and set to desired shape;

d) maintaining said temperature for at least about 15 minutes minimum to reset the crystalline structure and long lasting memory of said thermoplastic resin material of said visor insert to the desired shape;

e) gradually cooling said visor insert in said mold to a temperature of less than about 150° F. over a period of about 40 minutes to about 60 minutes after said at least 15 minutes heating to avoid degradation and loss of said reset long lasting memory and removing from said mold; and f) whereby said visor insert upon removal from said mold will retain the desired shape even under distortion of said visor insert and under temperatures of about 180° F. to about 200° F. for a period of at least 5 hours without loss of said reset long lasting memory.

14. The method of claim 13, including the steps of:

a) providing a hat having a visor with pocket for receiving a visor insert; and b) inserting said cooled reset visor insert into said pocket.

15. The method of claim 14 and including the step of:

a) closing the pocket subsequent to receiving the visor insert.

16. The method of claim 1, including the steps of:

a) providing a cap having a 3 ply visor with top and bottom plies of a woven fabric and middle ply being said visor insert; and b) sewing together said top and bottom plies to said visor insert.

17. A flexible thermoplastic resin visor insert having a reset crystalline structure adapted to retain its desired shape even under distortion under temperatures of about 180° F. to about 300° F. for a period of at least five hours;

a) said visor insert made from a thermoplastic resin material that has been heated to a temperature of from about 350° F. to about 375° F. for at least about 15 minutes minimum and gradually cooling to a temperature of less than 150° F. over a period of from about 40 minutes to about 60 minutes;

b) said thermoplastic resin material having a thickness of about 0.045" to about 0.75";

c) said thermoplastic resin material having a tensil strength of between about 2750 psi to about 5000 psi;

d) said thermoplastic resin material having a flexural strength of between about 1680 psi to about 8500 psi;

e) said thermoplastic resin material having a flexural modulus elasticity of between about 45,000 psi to about 280,000 psi; and f) said thermoplastic resin material having a melt temperature of between 470° F. to about 510° F.

18. A flexible thermoplastic resin visor insert as in claim 17 and including:

a) a hat;

b) a pocket in said hat; and c) said flexible thermoplastic resin visor insert positioned in said pocket.

19. A flexible thermoplastic resin visor insert as in claim 17 and wherein:

a) said thermoplastic resin material's thickness is in the range of 0.055: to 0.065";

b) said thermoplastic resin material's tensil strength is about 3000 psi;

c) said thermoplastic resin material's flexural strength is about 3500 psi to about 550 psi;

d) said thermoplastic resin material's flexural modulus elasticity is about 95,000 psi to about 160,000 psi;

e) said heating temperature is about 350° F.; and f) said heating temperature is maintained about 20 minutes.

20. A flexible thermoplastic resin visor insert as in claim 17 and wherein:

a) said insert is a crescent.

21. A flexible thermoplastic resin visor insert as in claim 17 and wherein:

a) said insert is an inverted V.

22. A flexible thermoplastic resin visor insert as in claim 18 and wherein:

a) said hat includes a visor; and b) said visor and visor insert are stitched together.

23. A flexible thermoplastic resin visor insert as in claim 18 and wherein:

a) said visor includes a top and bottom; and b) said visor insert is positioned between said top and bottom.

* * * * *

UNITED STATES PATENT AND TRADEMARK OFFICE

CERTIFICATE OF CORRECTION

PATENT NO. : 6,138,279
DATED : October 31, 2000
INVENTOR(S) : Alan E. Gore

It is certified that error appears in the above-identified patent and that said Letters Patent is hereby corrected as shown below:

Column 4,
Line 21, please change "350°" to -- 320° -

Column 5,
Line 28, please change "350°" to -- 320° --;

Column 6,
Line 4, please change "300°" to -- 200° --;
Line 7, please change "350°" to -- 320° --;
Line 37, please change "550" to -- 5500 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*